United States Patent [19]

Choporis et al.

[11] 4,019,511

[45] Apr. 26, 1977

[54] PORTABLE CONDITIONED AIR BREATHING DEVICE

[76] Inventors: Peter N. Choporis, 543 S. Beverly Lane, Arlington Heights, Ill. 60005; Robert N. Choporis, 880 N. Lake Shore Drive, Chicago, Ill. 60611

[22] Filed: Sept. 11, 1975

[21] Appl. No.: 612,278

[52] U.S. Cl. ..... 128/212; 128/192; 128/186; 128/203

[51] Int. Cl.[2] ..... A62B 7/12

[58] Field of Search ..... 128/212, 186, 187, 191 R, 128/192, 193, 194, 196, 197, 209, 210, 142 R, 203, 205, 146, 146.3, 146.4, 146.5, 142.2, 142.3

[56] References Cited

UNITED STATES PATENTS

| | | | |
|---|---|---|---|
| 2,581,709 | 1/1952 | Rogers | 128/191 R |
| 3,390,676 | 7/1968 | Warncke et al. | 128/191 R |
| 3,863,629 | 2/1975 | Ries | 128/142 R |

FOREIGN PATENTS OR APPLICATIONS

| | | | |
|---|---|---|---|
| 210,601 | 6/1907 | Germany | 128/212 |
| 5,447 | 3/1910 | United Kingdom | 128/212 |
| 137,902 | 1/1920 | United Kingdom | 128/212 |

*Primary Examiner*—Robert W. Michell
*Assistant Examiner*—Henry J. Recla
*Attorney, Agent, or Firm*—Johnston, Keil, Thompson & Shurtleff

[57] ABSTRACT

A portable conditioned heated air breathing device is provided comprising a compartmented canister with a collapsible hose storage compartment, an air conditioning compartment and a heating compartment and which also contains an ejector for ejecting an additive into the conditioned air as well as a structural arrangement for mixing fresh air with heated air, a filter for filtering the air and a device for igniting a burner from the outside of the canister and a manually controllable valve for controlling the flow of fuel to the burner.

16 Claims, 16 Drawing Figures

PORTABLE CONDITIONED AIR BREATHING DEVICE

BACKGROUND

Various devices have heretofore been proposed for providing heated air for persons having respiratory problems as disclosed, for example in U.S. Pat. Nos. 398,991; 427,179; 438,464; 603,021; 3,200,819; 3,249,108; 3,333,585; Re. 20,135; 3,139,885; and 3,707,966.

Despite the many attempts that have been made in the past to provide devices and appliances for warming or heating air for personal breathing, there is a definite need for an improved portable conditioned air breathing device containing a heating unit which will condition the air and which can be worn without discomfort by the user and utilized over a long period of time.

OBJECTS

One of the objects of the present invention is to provide a new and improved portable conditioned air breathing device which is compact and simple in structure.

Another object of the invention is to provide a breathing device of the type described containing a collapsible hose in a storage compartment which is adapted to be withdrawn from and coupled to the storage compartment and use in conjunction with a face mask.

Another object of the invention is to provide a portable conditioned air breathing device of the type described in which there is a heating compartment in heat exchange and air-tight relationship with respect to an air conditioning compartment wherein the heating compartment contains a metal flame tube with a burner at one end and heat exchange elements extending from the flame tube into the air conditioning compartment.

Still a further object of the invention is to provide a new and improved device of the type described containing means to mix conditioned air with an additive to increase the humidity or for medicinal purposes.

Another object of the invention is to provide a portable conditioned air breathing device of the type described having means for mixing fresh air with heated air and for controlling the flow of fresh air.

Still another object of the invention is to provide a portable conditioned air breathing device of the type described wherein the heating compartment has an opening at the top comprising a weather cap which covers said opening and is axially adjustable and removable.

Other objects and advantages of the invention will appear from the following description in conjunction with the accompanying drawings.

THE DRAWINGS

BRIEF SUMMARY OF THE INVENTION

In accordance with the invention a portable conditioned air breathing device is provided comprising a compartmented canister having a plurality of compartments running from the top toward the bottom thereof, including a collapsible hose storage compartment, an air conditioning compartment having one or more fresh air inlets and a heating compartment in heat exchange relationship with the air conditioning compartment, the hose storage compartment having coupling means at one end thereof for a collapsible hose and an opening in a side wall for transmitting conditioned air from the air conditioning compartment to said storage compartment and to a collapsible hose connected to said storage compartment. A compartment can also be provided in said canister for holding an additive for the conditioned air with means for ejecting said additive into the air conditioning compartment. The heating compartment preferably comprises an elongated metal flame tube having a combustion unit in one end and extending upwardly to an opening in the top of the canister where combustion exhaust gases are discharged through said opening, said flame tube containing metal fins which project into the air conditioning compartment. Means are also provided for introducing fresh air through inlets at the bottom of the canister and passageways to inlets in the sides of the upper part of the air conditioning compartment. In addition, means are provided on the side of the canister for igniting the burner and for controlling the flow of fuel to the burner. Means are also provided for mixing fresh air with heated air and for filtering the air. Another feature is the provision of means for stopping the flow of fuel to the burner automatically when the flame is extinguished. A further feature is the provision of a weather cap which is adjustable and also removable.

DETAILED DESCRIPTION OF THE INVENTION

Figure 1:
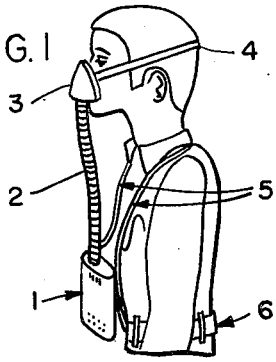
FIG. 1 is a perspective view illustrating in general the manner in which a portable conditioned air breathing device embodying the invention is used.

Referring to the drawings, FIG. 1 illustrates the use of the device herein which is embodied in a canister generally indicated at 1 connected by a flexible collapsible hose 2 to a face mask 3 which is held on the head of the user by a strap 4. The canister 1 is supported by shoulder straps generally indicated at 5 and a belt generally indicated at 6 which are fastened to the canister in any suitable manner.

Figure 2:
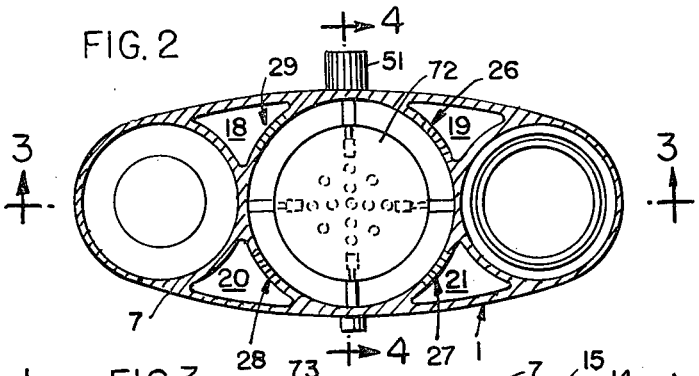
FIG. 2 is a top plan view of a portable conditioned air breathing device embodying the invention.
Figure 3:
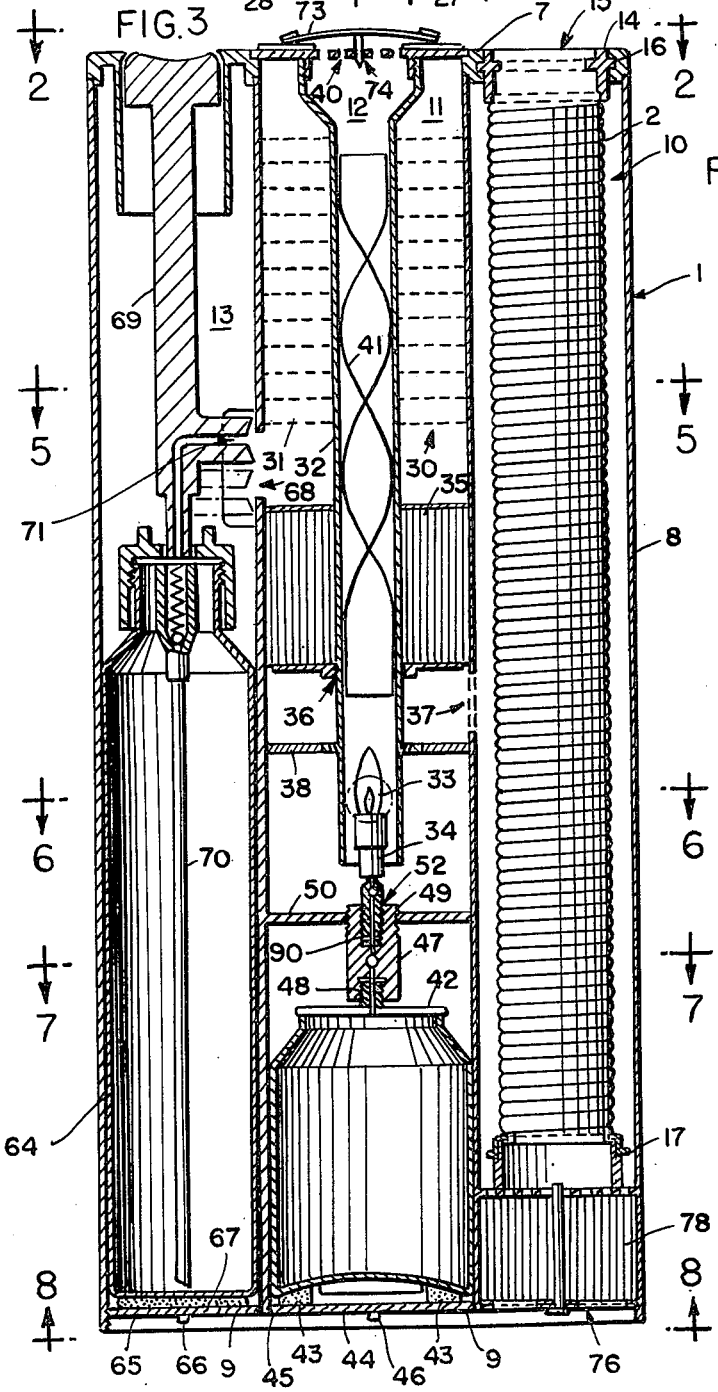
FIG. 3 is an elevational section taken along the line 3,3 of FIG. 2.
Figure 4:
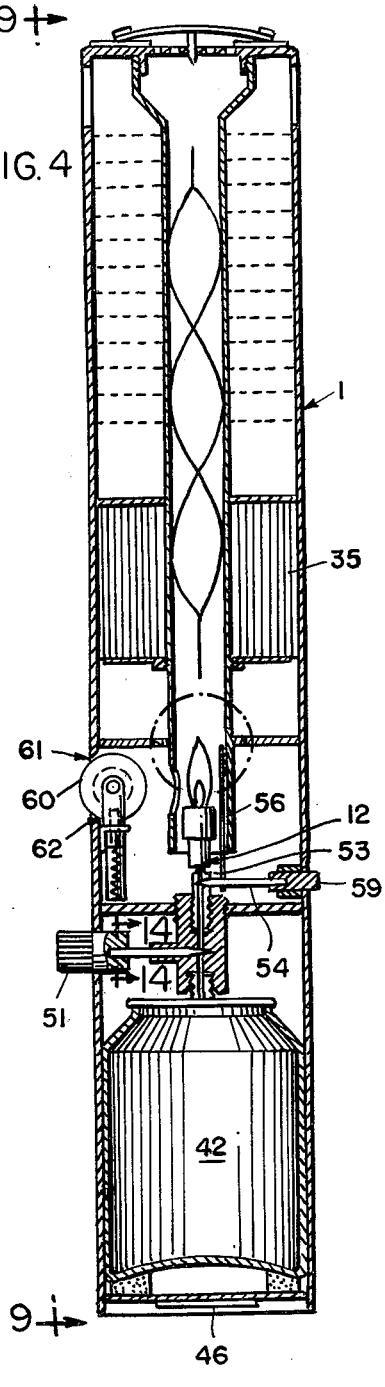
FIG. 4 is a sectional view taken along the line 4,4 of FIG. 2.
Figure 5:
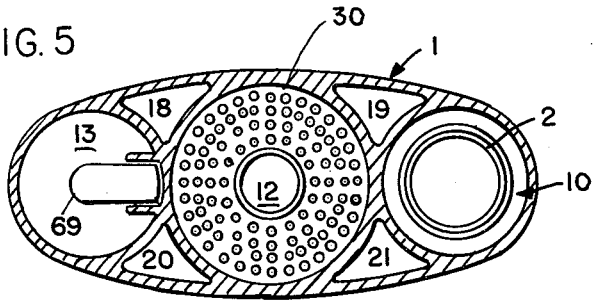
FIG. 5 is a sectional view taken along the line 5,5 of FIG. 3.
Figure 6:
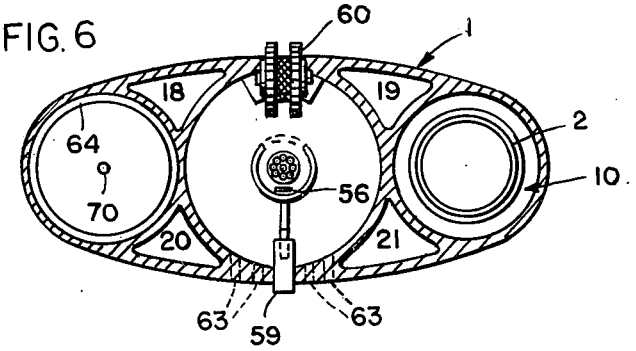
FIG. 6 is a sectional view taken along the line 6,6 of FIG. 3.
Figure 7:
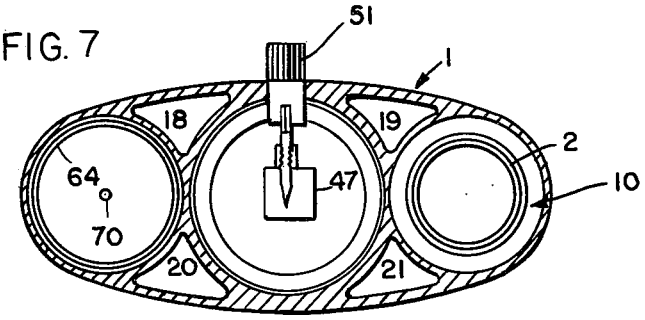
FIG. 7 is a sectional view taken along the line 7,7 of FIG. 3.

As illustrated in FIGS. 2 to 4, the canister 1 comprises a top portion 7, sides 8 and bottom 9 and is generally eliptical in cross section, although the cross sectional shape is subject to variation and modification.

Within canister 1 and running from the top toward the bottom thereof are a hose storage compartment 10, an air conditioning compartment 11, a heating compartment 12 and a compartment 13 which contains means for introducing moisture or other additive for medical purposes into the air conditioning compartment 11. In compartment 10 the collapsible flexible tube 2 is retained by a coupling means 14 in opening 15 in the top of canister 1. Preferably the coupling means is secured by threads 16 or other suitable means in the sides of the opening 15 so that the flexible tube 2 can be released from the position shown in FIG. 3, pulled out of the storage compartment 10 and recoupled by means of threads 17 or in any other suitable manner to the opening 15 in the top of canister 1.

Figure 8:
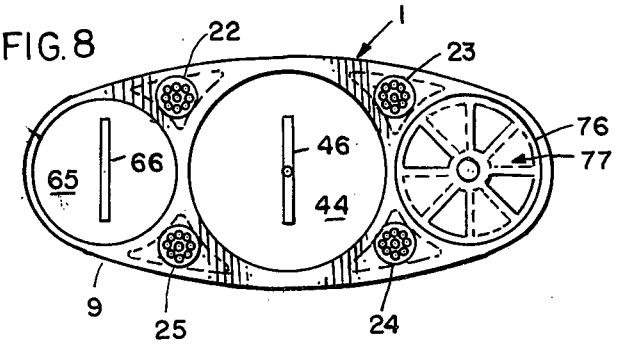
FIG. 8 is a bottom plan view taken along the line 8,8 of FIG. 3.
Figure 10:
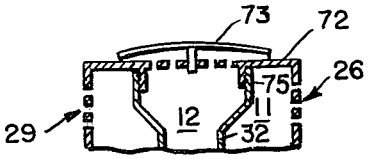
FIG. 10 is a detailed sectional view of the weather cap at the top of the canister and also showing the fresh air inlets to the air conditioning compartment.

Fresh air is introduced into passageways 18, 19, 20 and 21 through inlets 22, 23, 24 and 25 in the bottom 9 of canister 1, as shown in FIG. 8, flows upwardly through the passageways 18, 19, 20 and 21 and through inlets 26, 27, 28 and 29 to air conditioning compartment 11. In air conditioning compartment 11 the air flows downwardly through a heat exchanger generally indicated at 30 which preferably comprises a series of metal fins 31 attached to the outer wall of flame tube 32 which is also made of metal. The walls of flame tube 32 are heated by flame 33 from burner 34 and the heat is conducted to the heat exchanger 30 which in turn transmits it to the fresh air flowing downwardly through compartment 11. A filter 35 is disposed in compartment 11 in concentric relationship with flame tube 32 in order to remove any solid particles which may be carried in the air. Filter 35 is mounted on flame tube 32 and held in place by means of threads at 36, or in any other suitable manner, so that it can be removed and replaced. After passing through the filter 35, the conditioned air passes through opening 37 to compartment 10 and thence through the flexible tube 2 to a mask on the face of the user as shown in FIG. 1.

Figure 11:
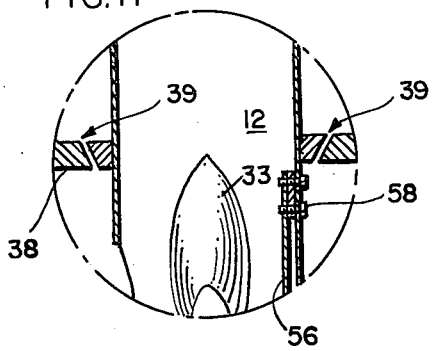
FIG. 11 is a detailed sectional view of a portion of the apparatus showing the manner in which the flame tube is installed.

Flame tube 32 is mounted in compartment 11 by cross member 38 secured to the inner sides of compartment 11 and a ground joint seal at 39, as illustrated in FIG. 11. Thus, the air conditioning compartment 11 is air-tight with respect to the heating compartment 12 so that the gases of combustion must all pass through opening 40 in the top of the canister and no gases of combustion can enter the air conditioning compartment 11.

The flame tube 32 contains a heat economizer 41 in the form of a spiral metal strip which causes the combustion gases to move in a tortuous path thereby increasing the efficiency of the heat exchange between compartment 12 and compartment 11. For the purpose of the invention it is preferable to use liquefied butane or similar gas fuel which is contained in a disposable and replaceable type container 42 made of transparent nylon or metal, or other suitable material, and seated on bumpers 43 made of rubber or other suitable resilient material and resting on the inside of the bottom 9 of canister 1. Container 42 is removable by unscrewing cap 44 which is threadedly connected to the bottom 9 at 45 and contains a cross bar 46 which may be grasped by the hand for the purpose of rotating cap 44. Main fuel control valve 47 is threadedly secured to container outlet 48 and is threadedly mounted at 49 on cross member 50 which is welded or otherwise secured to the inside of the prolongation of compartment 11. The burner 34 is of the jet type. Valve 47 is a needle-type valve controlled by rotating a knob 51 as shown in FIG. 4 which is disposed on the outside of canister 1 so that it can be readily grasped by the hand of the user. By rotating knob 51 the size and intensity of flame 33 can be controlled. Burner 34 is threadedly secured to valve 47 at 52 so that the burner jet can be removed and cleaned when desired.

Figure 12:
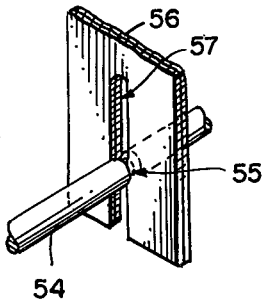
FIG. 12 is a detailed view of means for automatically holding open the fuel valve after flame has been established and for closing it when the flame is extinguished.

As a safety precaution a valve 53 is provided having a valve stem 54 with a groove 55 therein a shown in FIG. 12. A bi-metallic strip 56 containing a slot 57 is connected to the inside wall of flame tube 12 by means of rivets 58 or in any other suitable manner so that the slot 57 is disposed in groove 55 of valve stem 54. Valve 53 is a spring-type normally closed thermostatically operated and manual start-up valve. A manual start button 59 is depressed to open valve 53. When flame is established, heat from the flame flexes bi-metallic strip 56 which acts against the valve spring in valve 53 to hold the valve open. When the flame is extinguished for any reason, bi-metallic strip 56 flexes in the opposite direction, thereby allowing the spring in valve 53 to close the valve.

The burner is ignited initially in a conventional manner by rotating the knurled wheel 60 which projects through an opening 61 in canister 1. When wheel 60 is rotated it creates a spark by friction against flint 62. At the same time, button 59 is depressed and valve 47 is opened so that fuel from storage unit 42 can enter burner 34 and be ignited to create flame 33. After the burner has been ignited, button 59 can be released and valve 53 will be held away from the passageway to the burner by metallic strip 56. The size of the flame can be controlled by turning knob 51 of valve 47. Combustion air and ventilation of the fuel storage and main fuel compartment is provided through holes 63 in canister 1 (see FIG. 9).

Compartment 13 contains a container 64 for liquids such as water or solutions used as inhalants for medical purposes. Container 64 can be inserted and removed through removable cover 65 which is threadedly secured to the bottom of the canister and can be rotated by grasping bar strip 66. A sponge-type rubber, or other resilient retainer disc 67 is cemented to the inside surface of cover 65. Liquids in container 64 are ejected through opening 68 into air conditioning compartment 11 by pressing downwardly on pump stem 69 thereby causing the liquid to be forced upwardly through tube 70 and to be discharged through orifice 71 when it reaches the dotted line position shown in FIG. 3.

The openings 40 in the top of compartment 12 are provided by perforations in plate 72 and a weather cap 73 made of metal, or other suitable material, is threadedly secured to plate 72 at 74 so that it can be rotated axially in order to provide a space between the top of canister 1 and the inside of the weather cap for outward flow of combustion gases during inclement weather conditions. The weather cap 73 can also be completely removed. Perforated plate 72 is threadedly secured at 75 to the outer part of flame tube 12 so that it can be removed and cleaned.

Another important feature of the invention is the provision of an adjustable damper 76 which is mounted in the bottom of canister 1 and contains openings 77 which can either partially or completely be opened and closed by rotating damper 76 and thereby permit the addition of fresh unheated air to the previously conditioned air for the purpose of adjusting the temperatue of the conditioned air and/or the humidity to suit the needs of the user. A filter 78 is provided in order to filter out any solid particles which may be present in the air admitted through the adjustable damper 76. The filter may consist of filter pads or cloth screens which are effective to keep out insects and also to keep the larger particles in the air from entering the device.

Figure 16:
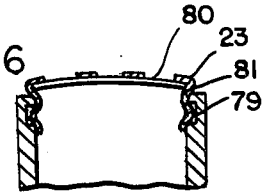
FIG. 16 is a side sectional view taken along the line 16,16 of FIG. 15.

The four perforated inlets 22, 23, 24 and 25 are of the snap-in type and contain snap-in members 79 as shown in FIG. 16 and also include a filter disc 80 made from non-allergic filter material which fits in the ridge 81 of the inlet members.

Figure 9:
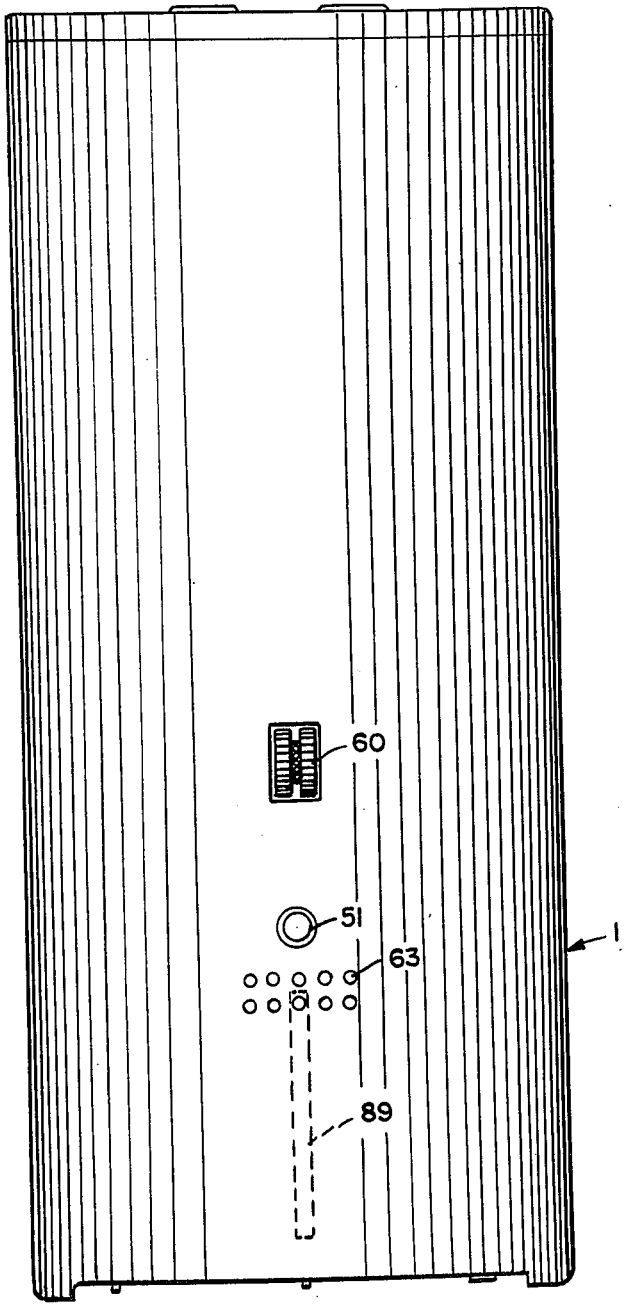
FIG. 9 is a front elevational view showing the exterior of the portable conditioned air breathing device embodied in FIGS. 1 to 8.
Figure 13:
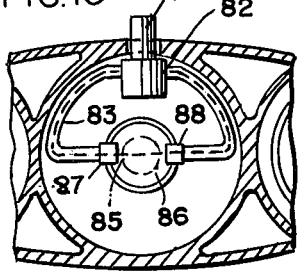
FIG. 13 is a detailed view of an alternate structure for electrical ignition.
Figure 14:
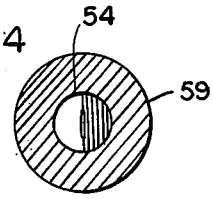
FIG. 14 is a detailed view of the valve stem for a main fuel control valve and a valve control knob with a spring for frictionally holding the valve stem and the knob.
Figure 15:
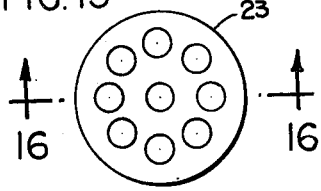
FIG. 15 is a detailed view of a snap-in button type prefilter which is disposed in the fresh air inlets at the bottom of the canister.

As illustrated in FIG. 13, an alternate system of electric ignition can be used by employing a crystal-type electric generator (Piezo Electric) 82 having insulated electric wire leads 83 and operated by a push button 84 which has a spring return. Actuation of push button 84 generates a spark between high temperature electrodes 85 and 86 which are carried by porcelain insulators 87 and 88.

Where a transparent container is used for the fuel, the level can be observed through a transparent opening 89 in the outside of the canister 1 as shown in FIG. 9.

MODE OF OPERATION

The fresh air (air for breathing) enters the canister through for intake openings 22, 23, 24 and 25 at the bottom of the canister and passes upwardly through passageways 18, 19, 20 and 21 and openings 26, 27, 28 and 29 into air conditioning compartment 11. The air is heated by passing through the perforated fin heat exchangers generally indicated at 30, heat being supplied to the heat exchanger elements by conduction and radiation from the flame tube 12 which in turn receives heat from the flame 33. Hot gases flow upwards in the combustion tube 12 and around the metal strip heat economizer 41. The burner 34, through a system of control valves, and a feed system burns liquefied gas supplied by fuel container 42. The burner is equipped with an orifice plate 90 which is designed to pass only the required fuel to the burner thereby eliminating possible excess fuel supply and the consequent overheating of the device. Modulation of the fuel supply from the safe maximum amount as determined by the orifice, down to complete shutoff of the fuel supply is controlled by the main fuel control valve 47.

By the time fresh air leaves the bottom row of the perforated fin heat exchanger 30 it is heated to maximum temperature as determined by the intensity of the burner flame. At this point, humidification of the fresh air may be accomplished by adding water in the form of a spray or mist to the hot fresh air through opening 68 ahead of the entering side of the main air filter and evaporator cartridge 35.

When necessary, as prescribed by a physician, medication may be substituted instead of water by removing the water from the liquid bottle 64 and replacing it with medication, or exchanging the water bottle with a matching bottle containing the medication. It is also possible to replace the standard main filter cartridge 35 with one containing medication saturated into the filter cartridge thereby passing the fresh heated air through the medicated filter to provide medicated vapors for therapeutic treatment.

The main air filter and evaporator cartridge 35 is preferably made up of two sections, the first section located at the air-entering side of the cartridge containing high efficiency non-allergic air filtering media, and the second section containing activated carbon granules for a limited degree of air purification. The casing containing the two sections is preferably made of waterproof material such as plastic material with the top and bottom perforated for the air passing through the unit. The cartridge is removable and replaceable.

During warm summer weather the device can be used to provide some relief by cooling the air by evaporation of water sprayed into the vaporizor air chamber and trickling into the filter cartridge 35 thereby saturating the filter media and the activated carbon granules which will then cool the air by evaporation. The degree of cooling will depend upon the dryness or humidity of the ambient air. This cooling will provide some comfort and lower the effects of heat prostration.

The invention is especially intended for portable use by out-patients susceptible to attacks of sundry cardiorespiratory ailments when such persons are exposed to cold outside air. Also, use by normal persons suffering from the common cold may find relief in the home or office or in transit by the use of this device. Older people, suffering from cardiovascular or pulmonary disease may find comfort by the use of this device, especially when exposed to cold outdoor weather while walking or engaging in outdoor sports such as hunting, snowmobiling, or watching football. Normal persons using this device outdoors during severe cold weather will find comfort as well as endure the severe weather longer while participating in active winter sports such as skiing, tobogganing or skating.

It is thought that the invention and its numerous attendant advantages will be fully understood from the foregoing description, and it is obvious that numerous changes may be made in the form, construction and arrangement of the several parts without departing from the spirit or scope of the invention, or sacrificing any of its attendant advantages, the forms herein disclosed being preferred embodiments for the purpose of illustrating the invention.

The invention is hereby claimed as follows:

1. A portable conditioned heated air breathing device comprising a compartmented canister having a top, sides and bottom and containing a plurality of side by side compartments running from the top toward the bottom thereof, said compartments comprising:

a. a conditioned air and breathing tube means compartment containing breathing tube means and having exit means for said breathing tube means at the upper end of said compartment and an inlet opening in a sidewall for transmitting conditioned air to said compartment, whereby conditioned air can be transmitted from said compartment through said tube breathing means to the user, b. an air conditioning compartment adjacent said compartof (a) having one or more openings in a sidewall and at the upper end thereof and an outlet opening in a sidewall thereof communicating with said inlet opening in said compartment of (a), passageways extending longitudinally of and adjacent to said air conditioning compartment and having air inlet openings at the lower ends thereof adjacent the lower end of said canister, said passageways communicating with said air conditioning compartment via said inlet openings in the sidewall thereof, whereby fresh air enters said air inlet openings in said passageways and passes through said inlet openings at the upper end of said air conditioning compartment.

c. a heating compartment in heat exchange relationship with said compartment of (b), said compartment of (b) being airtight with respect to said heating compartment and said heating compartment comprising an elongated metal tube and heating means for said tube whereby the walls of said tube are heated, said heated walls being within and spaced from the inner walls of the compartment of (b) whereby fresh air introduced into said inlet openings of said compartment of (b) passes along said heated walls and is heated by heat exchange therewith prior to passing through said outlet opening to said compartment of (a) and therefter through said tube breathing means.

2. A device as claimed in claim 1 comprising a compartment in said canister for holding an additive to said conditioned air, a passageway between said compartment and said air conditioning compartment of (b) and means for ejecting said additive from said compartment to said compartment of (b).

3. A device as claimed in claim 2 wherein said additive is water and said means for ejecting said additive from said compartment containing said water consists of spray means for adding said water in the form of a spray or mist to hot fresh air in said compartment of (b).

4. A device as claimed in claim 1 in which said compartment of (c) comprises an elongated metal flame tube having a combustion unit in one end and extending upwardly to an opening in the top of said canister where combustion exhaust gases are discharged through said opening, said flame tube containing metal fins which are in contact with the outside of said flame tube and project into said compartment of (b).

5. A device as claimed in claim 4 in which said flame tube contains means to cause combustion exhaust gases from said combustion unit to move in a tortuous path.

6. A device as claimed in claim 1 comprising a gas permeable filter in said compartment of (b) adjacent said opening to the compartment of (a).

7. A device as claimed in claim 1 in which said heating compartment comprises a flame tube having in one end thereof a burner for burning vaporized fuel, said burner being mounted on and connected to a fuel storage vessel, said vessel being supported from the bottom of said canister.

8. A device as claimed in claim 7 comprising means mounted on the side of said canister for igniting said burner.

9. A device as claimed in claim 7 comprising means mounted on the side of said canister for controlling the flow of fuel to said burner.

10. A device as claimed in claim 1 comprising means for mixing fresh air with heated air.

11. A device as claimed in claim 10 wherein said means for mixing fresh air with heated air comprises an opening at the bottom of said canister communicating with said compartment of (a) and having an adjustable damper therein for controlling the flow of fresh air.

12. A device as claimed in claim 10 wherein an air filter is disposed in the path of the fresh air before it is mixed with the heated air.

13. A device as claimed in claim 1 in which said heating compartment has an opening in the top of said canister and comprises a weather cap which covers said opening and is adjustable axially with respect to said opening.

14. A device as claimed in claim 1 in which said heating compartment has an opening in the top of said canister and comprises a weather cap which covers said opening and is removable.

15. A device as claimed in claim 1 in which said heating compartment contains a combustion unit for fuel and a valve to control the flow of fuel, said valve being operable manually from the exterior of said canister.

16. A device as claimed in claim 1 in which said heating compartment contains a combustion unit for fuel and a valve to control the flow of fuel, said valve having means to hold it open while said combustion unit is ignited and to close it automatically when said combustion unit is extinguished.

* * * * *

UNITED STATES PATENT AND TRADEMARK OFFICE

CERTIFICATE OF CORRECTION

PATENT NO. : 4,019,511

DATED : April 26, 1977

INVENTOR(S) : PETER N. CHOPORIS and ROBERT N. CHOPORIS

It is certified that error appears in the above-identified patent and that said Letters Patent are hereby corrected as shown below:

Column 7, line 2, "compartof" should read --compartment of--.

Column 7, line 2, before "openings" insert --inlet--.

Signed and Sealed this twenty-sixth Day of July 1977

[SEAL]

*Attest:*

RUTH C. MASON
*Attesting Officer*

C. MARSHALL DANN
*Commissioner of Patents and Trademarks*